US008959963B2

(12) United States Patent
Stoll

(10) Patent No.: US 8,959,963 B2
(45) Date of Patent: Feb. 24, 2015

(54) SECURITY BOX WITH ATTACHED LOCK

(71) Applicant: Rodney Stoll, Peru, IN (US)

(72) Inventor: Rodney Stoll, Peru, IN (US)

( * ) Notice: Subject to any disclaimer, the term of this patent is extended or adjusted under 35 U.S.C. 154(b) by 0 days.

(21) Appl. No.: 13/896,203

(22) Filed: May 16, 2013

(65) Prior Publication Data

US 2013/0306496 A1 Nov. 21, 2013

Related U.S. Application Data

(60) Provisional application No. 61/647,513, filed on May 16, 2012.

(51) Int. Cl.

| | |
|---|---|
| ***B65D 5/14*** | (2006.01) |
| ***B65D 55/02*** | (2006.01) |
| ***E05B 65/00*** | (2006.01) |
| ***E05G 1/00*** | (2006.01) |
| *B65D 55/14* | (2006.01) |

(52) U.S. Cl.

CPC ..... *B65D 55/02* (2013.01); *E05B 65/006* (2013.01); *E05B 65/0075* (2013.01); *E05G 1/00* (2013.01); *B65D 55/14* (2013.01)

USPC ..... 70/63; 70/167; 206/1.5

(58) Field of Classification Search

USPC ..... 70/57, 63, 166, 168, 169; 206/1.5

See application file for complete search history.

(56) References Cited

U.S. PATENT DOCUMENTS

| | | | | |
|---|---|---|---|---|
| 2,723,484 | A * | 11/1955 | Nelson, Jr. | 43/54.1 |
| 3,934,434 | A * | 1/1976 | Law | 70/63 |
| 4,462,317 | A * | 7/1984 | Franko et al. | 109/45 |
| 4,469,345 | A * | 9/1984 | Weiss | 224/425 |
| 4,649,723 | A * | 3/1987 | Appelbaum | 70/63 |
| 6,006,558 | A * | 12/1999 | Peters | 70/63 |
| 7,257,972 | B2 * | 8/2007 | Bright | 70/58 |
| 7,807,923 | B2 * | 10/2010 | Moran | 174/50 |
| 8,020,416 | B2 * | 9/2011 | Talmage et al. | 70/85 |
| 2006/0230794 | A1 * | 10/2006 | Liu | 70/63 |
| 2008/0283434 | A1 * | 11/2008 | Gelardi | 206/468 |
| 2011/0036731 | A1 * | 2/2011 | Bortz | 206/1.5 |

* cited by examiner

*Primary Examiner* — Suzanne Barrett

(57) ABSTRACT

A security box is provided. The security box has a container part with an integral lock system and a security box lid that is adapted to slide onto a lip at the top edge of the container part of the security box and to fasten to the integral lock system.

4 Claims, 3 Drawing Sheets

SECURITY BOX WITH ATTACHED LOCK

CROSS-REFERENCE TO RELATED APPLICATION

This application claims the benefit of priority of U.S. provisional application No. 61/647,513, filed May 16, 2012, the contents of which are herein incorporated by reference.

BACKGROUND OF THE INVENTION

The present invention relates to locking devices and, more particularly, to locking devices for security boxes.

Many boxes designed to store and secure personal items are equipped with a latch or lock to fasten the lid of a box to the container part of the box comprising matching holes manufactured into the lid and the top of the container into which a padlock can be inserted. In these security box designs, the lid may also be attached to the container part by hinges between the lid and container on one side of the box. These two design features, the padlock accessory and the hinges, are a hazard in boxes used for prison inmates because these metal parts can be detached and thus provide inmates with weapons. For example, a padlock may be put into a sock or tied to a string or the like and used as a weapon to assault other prisoners or, even worse, staff. This can be a deadly weapon that is easily accessible to inmates.

As can be seen, there is a need for locking security boxes that dispenses with the need for metal parts such as a padlock or metal hinges.

SUMMARY OF THE INVENTION

In one aspect of the present invention, a security box comprises: a compartment part having a base, front wall, rear wall and sides integrally attached to and extending from the base; a lock mechanism integrated into a front side of the compartment part; rails protruding outwardly from top edges of the sides and rear wall of the compartment part; a lid adapted to grip the rails of the top edges of the sides and rear wall of the compartment part; and a latch strike attached to the lid adapted to engage the lock mechanism.

In another aspect of the present invention, a security box comprises: a compartment part having a base, front wall, rear wall and sides integrally attached to and extending from the base; a lock mechanism integrated into a front side of the compartment part; rails protruding outwardly from top edges of the sides and rear wall of the compartment part; a lid adapted to grip the rails of the top edges of the sides and rear wall of the compartment part; a latch strike attached to the lid adapted to engage the lock mechanism; a latch box of the lock mechanism receiving the latch strike to secure the lid in a locked position on the compartment part; a rear box slot formed in an upper portion of the rear wall of the container part, the rear box slot allowing the latch strike to pass therethrough when the lid is slid onto the container part; and a rear lid tab extending from the lid to cover the rear box slot when the lid is secured in a locked configuration.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a security box having a container part with an integral lock system and a security box lid that is adapted to slide onto a lip at the top edge of the container part of the security box and to fasten to the integral lock system.

Referring now to FIGS. 1 through 5, a security box, according to embodiments of the present invention, can include a container part 10 and a lid 12. The security box may be in various dimensions depending on storage requirements, and may be made of a strong rigid material such as heavy plastic or metal, for example, that may be resistant to penetration, puncture or cutting into. The security box may be finished with various colors, finishes or designs.

Figure 1:
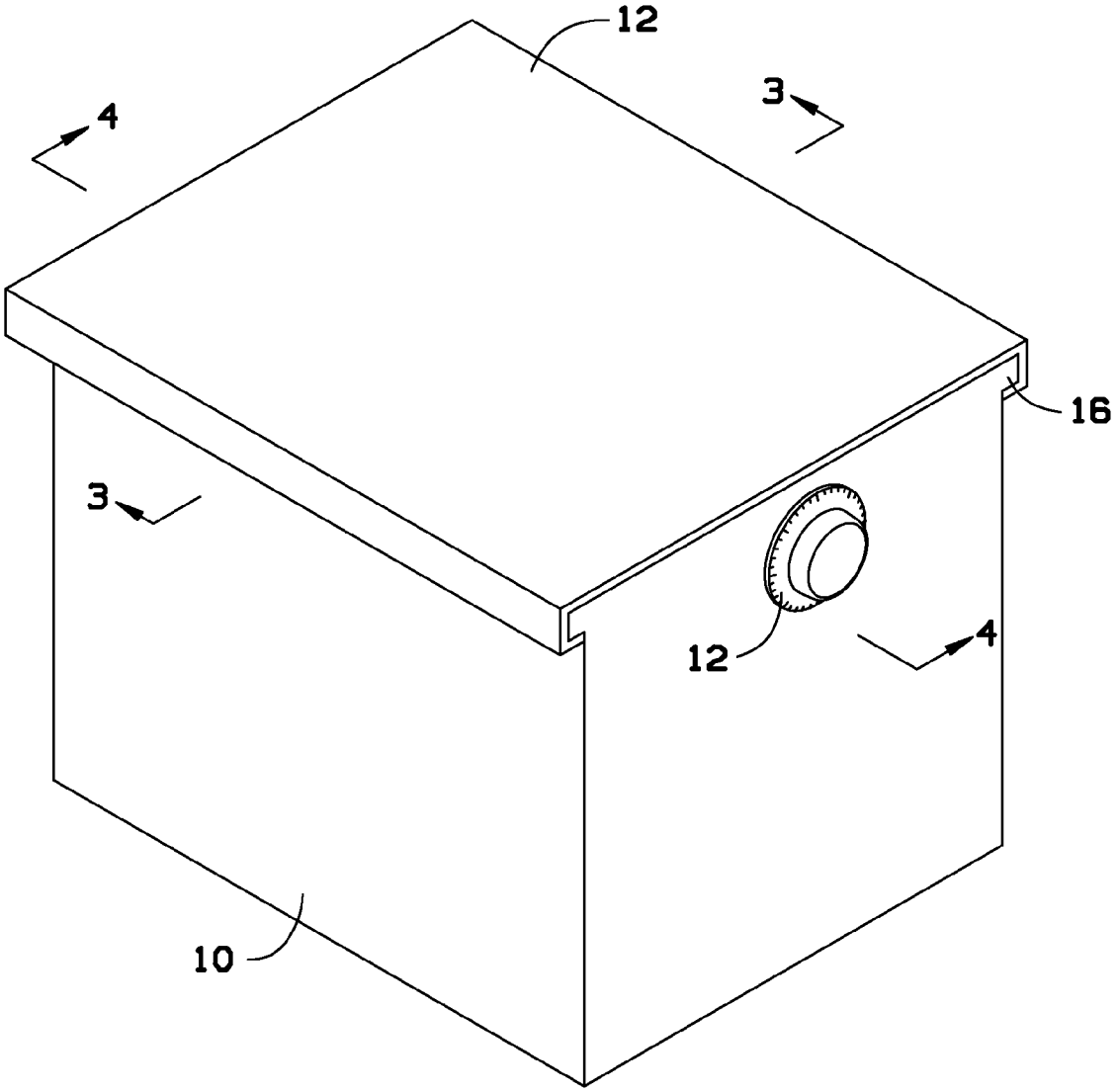
FIG. 1 is a perspective view of a security box according to an exemplary embodiment of the present invention.
Figure 2:
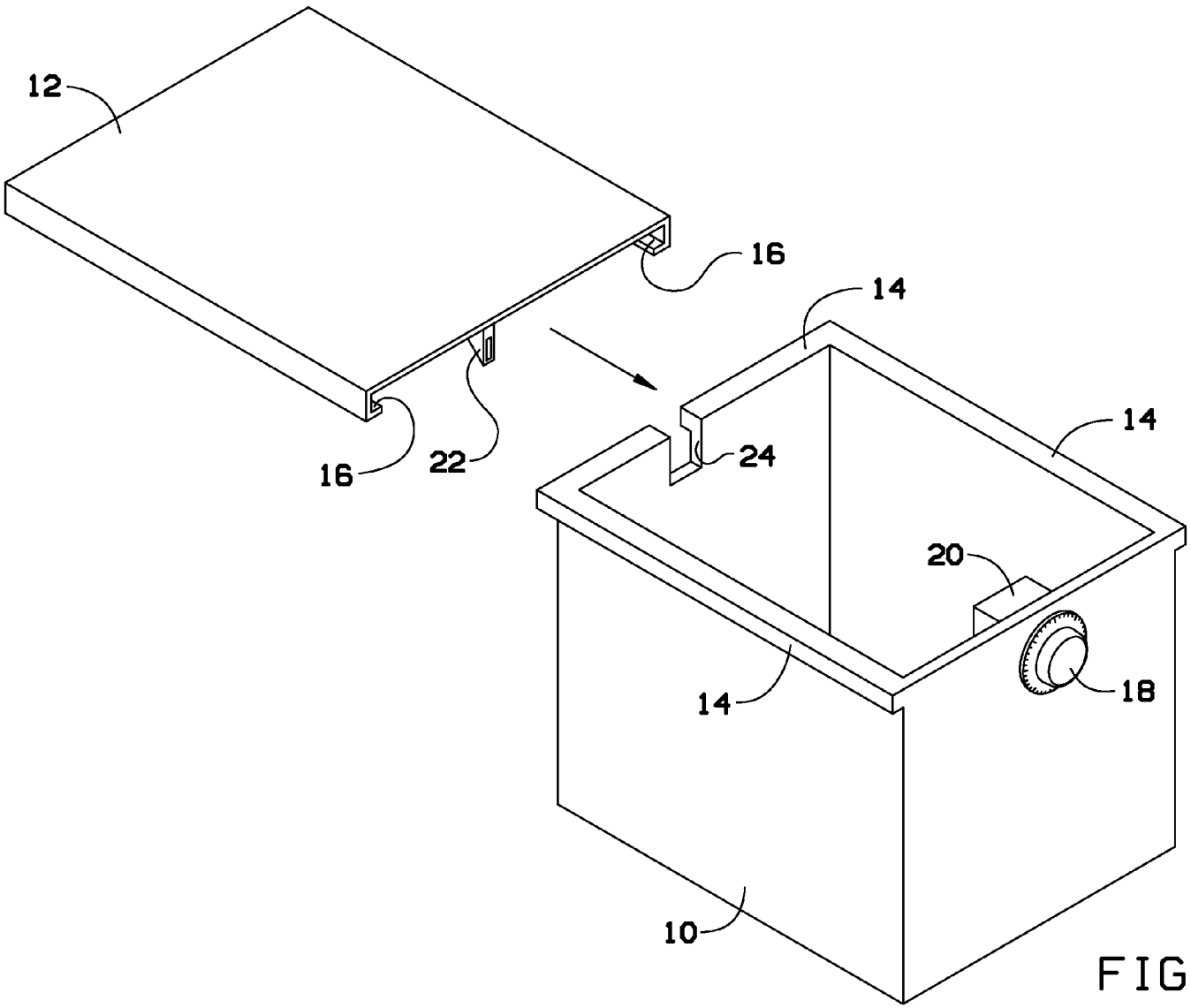
FIG. 2 is a perspective view of the security box of FIG. 1, illustrating attachment of the lid.
Figure 3:
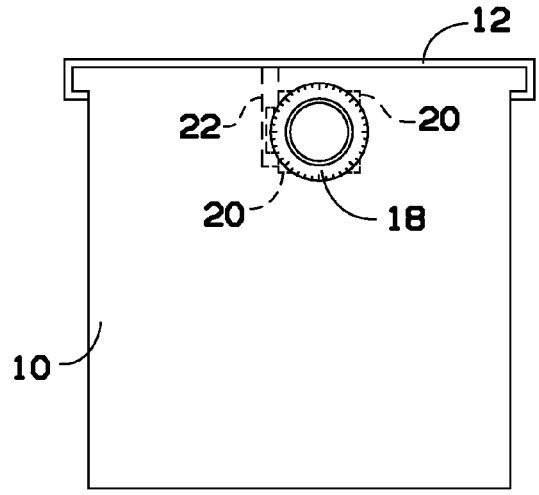
FIG. 3 is a front view of the security box of FIG. 1.
Figure 4:
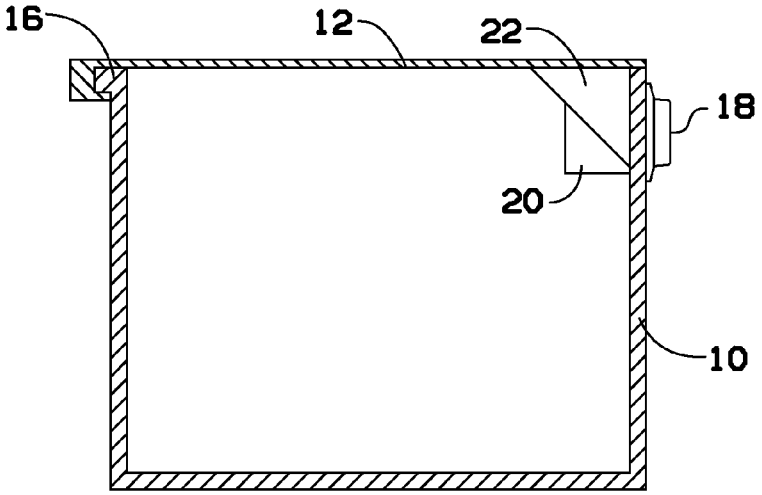
FIG. 4 is a cross sectional view taken along line 4-4 of FIG. 1.
Figure 5:
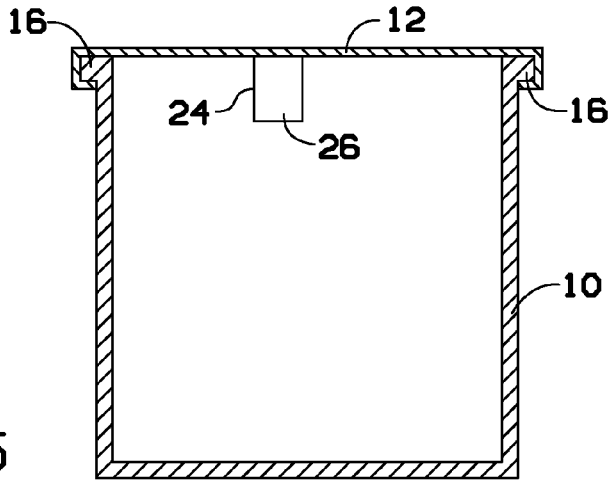
FIG. 5 is a cross sectional view taken along line 5-5 of FIG. 5.

The container part 10 of the security box may have rails 14 extending outwardly along the top edges of side and back panels of the container part 10 of the security box as shown, for example, in FIG. 2.

The container part 10 of the security box may also have a lock 18 and the body of the lock 18 can be placed within the interior of the security box, for example by incorporating the lock into the container part 10 as an integral part during the manufacturing process. In some embodiments, the lock 18 can be attached to the container part 10 by a strong adhesive, such as an epoxy, or with security bolts, or the like.

The security box may have a lid 12 that can include grooves 16 formed along the side and back portions of the lid 12. The grooves 16 are designed to fit about the rails 14 of the container part 10. In some embodiments, the grooves 16 may be U-shaped edges on the back and sides of the lid 12 that are adapted to engage the rails 14 extending around the tops of the sides and back of the container part 10 of the security box. A front edge of the lid may have a downward protruding member acting as a latch strike 22, which may also be made of the same material as the lid 12 or the container part 10 of the security box. The latch strike 22 may have various shapes, such as wedge shaped, or have various other profiles. The latch strike 22 can be adapted to mate with a latch box 20 in the lock 18 where it can be secured by operating the lock 18 to put it in a locked position by merely sliding the lid 12 toward the front of the container part 10 where it can engage the lock 18 and secure the box against being broken into. This method of locking the lid 12 onto the container part 10 can eliminate the need to lock the box using a padlock or other external and removable locking system. The described lock cannot be removed because it is an integral feature of the box.

While the Figures show a combination lock as the lock 18, the lock 18 can take on various forms. For example, the lock 18 could be a numeric or alpha-numeric lock having, for example, 3 or 4 wheels to dial in a combination to unlock the lock. Various other lock mechanisms may be used, provided that the lock mechanism does not include any removable elements, such as padlocks, that can be used as a weapon.

The container part 10 can include a rear box slot 24 to allow the latch strike 22 to pass while sliding the lid 12 into a locked position. A rear lid tab 26 can depend from the lid 12, at a rear side thereof such that the rear lid tab 26 covers the rear box slot 24 when the lid 12 is slid into a locked position on the container part 10.

The described security box can be particularly useful to replace the security property boxes in state and federal prisons and jails, making the environment safer both for inmates and staff. However, it can be usefully put to use by others, for example, the military can use the security box design for footlockers.

It should be understood, of course, that the foregoing relates to exemplary embodiments of the invention and that modifications may be made without departing from the spirit and scope of the invention as set forth in the following claims.

What is claimed is:

1. A security device comprising:

a compartment part having a base, front wall, rear wall and sides integrally attached to and extending from the base;

a lock mechanism integrated into a front side of the compartment part, wherein the lock mechanism is a combination lock, and wherein the lock mechanism does not include any components removable from the security box;

rails protruding outwardly from top edges of the sides and rear wall of the compartment part;

a lid adapted to grip the rails of the top edges of the sides and rear wall of the compartment part, wherein the compartment part and lid are made of a penetration resistant material, and wherein the lid opens and closes on the container box without the use of hinges;

a latch strike attached to the lid adapted to engage the lock mechanism;

a latch box of the lock mechanism receiving the latch strike to secure the lid in a locked position on the compartment part;

a rear box slot formed in an upper portion of the rear wall of the container part, the rear box slot allowing the latch strike to pass therethrough when the lid is slid onto the container part; and a rear lid tab extending from the lid to cover the rear box slot when the lid is secured in a locked configuration.

2. A security box comprising:

a compartment part having a base, front wall, rear wall and sides integrally attached to and extending from the base;

a lock mechanism integrated into a front side of the compartment part;

rails protruding outwardly from top edges of the sides and rear wall of the compartment part;

a lid adapted to grip the rails of the top edges of the sides and rear wall of the compartment part;

a latch strike attached to the lid adapted to engage the lock mechanism;

a latch box of the lock mechanism receiving the latch strike to secure the lid in a locked position on the compartment part;

a rear box slot formed in an upper portion of the rear wall of the container part, the rear box slot allowing the latch strike to pass therethrough when the lid is slid onto the container part; and a rear lid tab extending from the lid to cover the rear box slot when the lid is secured in a locked configuration.

3. The security box of claim 2, wherein the compartment part and lid are made of a penetration resistant material.

4. The security box of claim 2, wherein the lock mechanism is a combination lock.

* * * * *